US006189469B1

(12) United States Patent
Fukumoto

(10) Patent No.: US 6,189,469 B1
(45) Date of Patent: Feb. 20, 2001

(54) STRIP MATTER CUTTING DEVICE FOR SEWING MACHINE

(75) Inventor: Ryosuke Fukumoto, Toyonaka (JP)

(73) Assignee: Yamato Sewing Machine Seizo Co., Ltd. (JP)

( * ) Notice: Under 35 U.S.C. 154(b), the term of this patent shall be extended for 0 days.

(21) Appl. No.: 09/290,857

(22) Filed: Apr. 13, 1999

(30) Foreign Application Priority Data

Apr. 16, 1998 (JP) ..... 10-144974

(51) Int. Cl.[7] ..... D05J 37/08
(52) U.S. Cl. ..... 112/130; 112/122.3; 112/152
(58) Field of Search ..... 112/130, 122, 112/122.3, 129, 122.1, 152; 83/490, 901, 910, 921, 935, 938

(56) References Cited

U.S. PATENT DOCUMENTS

| | | | | |
|---|---|---|---|---|
| 2,126,521 | * | 8/1938 | Weis | 112/122.3 |
| 3,135,229 | * | 6/1964 | Heckethorn | 112/122.3 |
| 3,163,136 | * | 12/1964 | Pickett | 112/122 X |
| 4,735,160 | | 4/1988 | Hampel et al. . | |
| 4,892,047 | * | 1/1990 | Fieschi | 112/122 |
| 5,062,374 | | 11/1991 | Wokeck et al. . | |
| 5,197,400 | * | 3/1993 | Prais | 112/122.3 |

FOREIGN PATENT DOCUMENTS

| | | |
|---|---|---|
| 322954 | 6/1975 | (AT) . |
| 60-48195 | of 1985 | (JP) . |

* cited by examiner

*Primary Examiner*—Ismael Izaguirre
(74) *Attorney, Agent, or Firm*—D. Peter Hochberg; Katherine R. Vieyra; William H. Holt

(57) ABSTRACT

A strip matter cutting device for sewing machine is provided which is mainly employed in automatically cutting a tape or rubber sewed on the shoulders of a T-shirt. It is arranged such that the whole of a cutting part which comprises a rotary cutting blade and a tape receiving portion integrally formed with a tape pick-up portion, is shifted between a cutting action position closely adjacent to the rear of a needle location of a throat plate secured to the top surface of a sewing machine bed, and a non-action position at which the cutting part is retracted upward to the left of a sewing machine arm over the throat plate, through a rock arm which is driven to rock reciprocally by a rotary cylinder. Employment of this arrangement permits an improvement in work efficiency and a significant reduction in work burden. Even for a wide object to be sewed, it is fed freely for automatic cutting of a sewed tape or rubber, without the tape or rubber losses.

8 Claims, 7 Drawing Sheets

STRIP MATTER CUTTING DEVICE FOR SEWING MACHINE

BACKGROUND OF THE INVENTION

1. Field of the Invention

The invention relates to a strip matter cutting device for sewing machine which is used in, for example, a sewing operation in which a strip matter, such as a tape or rubber, is sewed on the shoulders of a T-shirt and the strip matter is then cut.

2. Description of the Prior Art

As shown in FIG. 9, in sewing the shoulders of a tubular T-shirt S while sewing a tape T on the outside thereof, being generally called "shoulder taping sewing," it is most suitable to use a vertical barrel special bed sewing machine M shown in FIG. 8. The shoulder taping sewing by using the bed sewing machine M can employ the following two manners which are generally called "shoulder taping feed sewing" and "shoulder taping delivery sewing", respectively.

In the former manner, an arm hole S1 of the T-shirt S is fed one after another in a direction of from front to rear of a special cylinder bed B of the bed sewing machine M, and they are allowed to pass through a pressure foot P and a sewing part H for taping sewing. When the special cylinder bed B is full with a plurality of the T-shirts S, sewing operation is interrupted and the pressure foot P is lifted. Then, a tape T extending continuously across the T-shirts S at their shoulders is cut with scissors, while taking out the separated T-shirts S along the special cylinder bed B by pulling them toward its front. After the T-shirts S are all removed from the special cylinder bed B, other T-shirts S are subjected to the foregoing steps, thus repeating this taping sewing.

In the latter manner, a pressure foot P of a vertical barrel special bed sewing machine M, the feed direction of which is the reverse of that of the aforesaid sewing machine, is firstly lifted and a plurality of T-shirts S to be taped are pushed, through an arm hole S1, into the rear of the a special cylinder bed B as many as possible, and then held there. The T-shirts S are continuously delivered one by one along the cylinder bed B to its front, such that they are allowed to pass through the pressure foot P and a sewing part H for taping sewing. When the T-shirts S are all subjected to the taping sewing, sewing operation is interrupted, and a tape T extending continuously across the T-shirts S at their shoulders is cut with scissors. Thereafter, other T-shirts S are subjected to the foregoing steps, thus repeating this taping sewing.

As a cutting device for strip matter, e.g., a shoulder tape, there is known a device employing a conventional construction as shown in FIGS. 10 and 11. In this device, a throat plate 52 having a needle location 51 is secured on the top surface of a sewing machine bed (not shown), and a stationary blade 53 and a movable blade 54 are provided on the rear of the throat plate 52 in the sewing direction (the direction indicated by arrow a in FIG. 10). The movable blade 54 is pivoted such that it is free to shift, via a rotary cylinder 55 or the like, between a standby position at which the movable blade 54 is spaced above the stationary blade 53 as indicated by a dotted line in FIG. 11, to allow for the passage of a tape, and a cutting position at which the movable blade 54 cuts the tape in cooperation with the stationary blade 53 by rocking downwardly as indicated by a solid line in FIG. 11.

As a modification of the cutting device shown in FIGS. 10 and 11, there are also known ones employing the construction disclosed in Japan Patent Publication No. 60-48195 (1985), Japan Utility Model Publication No. 7-5824 (1995), and Japan Patent Publication 2-17195 (1990). None of these are used with a vertical barrel special bed sewing machine, but they are used with a flat bed type covering chain stitch sewing machine (not shown), or a lateral bed type covering chain stitch sewing machine M1 in which a cylinder bed B1 projects from a sewing machine arm A in a lateral direction orthogonal to the sewing direction a, as shown in FIG. 12.

Of the above conventional techniques, in a case where a vertical barrel special bed sewing machine is used and a tape is cut with scissors, because of particularity in the shape of its sewing machine bed, it is necessary to select one of which rotating speed is generally low. In addition, when a taping sewing is terminated, the tape is cut with scissors by the operator. As a result, not only work efficiency is low as a whole, but also it is liable to cause variations in the length of tape cutting allowance, thus increasing tape losses which can be generated in sewing start and stop portions. Although the tape losses is reduced by adjusting the pitch of a continuous feed and delivery of T-shirts S, tape cutting with scissors imposes on the operator's wrist a considerable burden and exhaustion, thereby the operator might suffer from peritendinitis. This is unfavorable from the point of view of health care.

On the other hand, the cutting device for tapes and the like, as shown in FIGS. 10 to 11, or disclosed in the Publication No. 60-48195, can be readily attached to an existing sewing machine without need for a special reconstruction therefor, so that a tape or the like is cut mechanically and automatically. This imposes on the operator less work burden and thus avoids suffering from peritendinitis. However, since distance L from the needle location 51 to the cutting position is long (see FIG. 10), the tape losses caused in the sewing start and stop portions becomes considerably greater than that in the cutting with scissors as described.

In the cutting device for tapes and the like disclosed in the Publication No. 7-5824, the cutting position is set to a point immediately behind a pressure foot. Therefore, this device permits a further reduction in tape losses than the device of FIGS. 10 to 11, and that of the Publication No. 60-48195. It is, however, necessary to reconstruct a throat plate, a throat plate mount and a stationary blade so as to have a special construction. Thus it is unavoidable to increase the cost of the overall device.

In addition, the device of FIGS. 10 to 11, and those of the Publications No. 60-48195 and 7-5824 have the same problem that when they are used in sewing a wide object, a cutting part itself at which a tape or the like is cut may obstruct passage and movement of the object, failing to perform a predetermined sewing operation. This problem is, however, unsolvable even if such a cutting device is attached to a vertical barrel special bed sewing machine.

In the cutting device of the Publication No. 2-17195, since the cutting position is set to a point immediately behind a pressure foot in common with the Publication No. 7-5824, tape losses can be reduced. However, since its cutting blade moves down linearly from obliquely upward of a throat plate to the throat plate immediately behind the pressure foot, there is needed such a special improvement in construction that a stationary blade to be cooperated with the cutting blade is attached to the throat plate. Although the cutting device of the Publication No. 2-17195 can be also used with a vertical barrel special bed sewing machine, there is needed such an improvement in construction that a stationary blade is attached to the throat plate. Further, strength and durability problems can arise because a generally slender barrel cylinder bed part is subject to a strong impact due to the linear movement of the cutting blade.

SUMMARY OF THE INVENTION

In view of the actual conditions as stated above, it is a primary object of the invention to provide a strip matter cutting device for sewing machine which is useable by attaching to a variety of bed type sewing machines, such as a vertical barrel special bed sewing machine, a lateral barrel bed sewing machine and a flat bed type sewing machine, without need for a special reconstruction and improvement in construction, thereby permitting an increase in work efficiency and a substantial reductions in work burden. Even when this cutting device is employed in sewing a wide object, a sewed strip matter is mechanically and automatically cut in the vicinity of a needle location, without constituting any obstruction to the feed of the wide object.

It is a further object of the invention to eliminate damage to a cutting part and the top surface of a sewing machine bed when a strip matter is cut at a position on the top surface of the bed.

It is yet another object of the invention to provide an arrangement such that a cutting part is compact as a whole, and impact upon cutting is reduced as much as possible. Thereby, when the cutting device is used with a vertical barrel special bed sewing machine, an improvement in strength and durability is achieved without any special reinforcement of a slender barrel cylinder bed part.

To accomplish the primary object, a strip matter cutting device for sewing machine according to a first aspect of the invention comprises a strip matter cutting unit having a cutting part for cutting a strip matter sewed on an object in its width direction; a cutting part shifting means for shifting the whole of the cutting part between a cutting action position closely adjacent to the rear of a needle location on the top surface of a sewing machine bed, and a non-action position at which the cutting part is retracted upwardly from the top surface of the sewing machine bed such that an object transferred along the top surface of the sewing machine bed is free to pass through the needle location; and a driving means for driving the cutting part so as to effect cutting at the cutting action position.

In the cutting device so arranged, when an object to be sewed is subjected to a strip matter sewing while being transferred along the top surface of the sewing machine bed, the whole of the cutting part is retracted to the non-action position above the top surface of the sewing machine bed, thus constituting no obstruction to the feed of the object. Even for a wide object to be sewed, the object and a strip matter are allowed to pass and move smoothly through the needle location in order to ensure a sewing operation including a predetermined strip matter sewing. After the strip matter sewing, the whole of the cutting part of the cutting unit is shifted to the cutting action position in the vicinity of the rear of the needle location on the top surface of the sewing machine bed, such that the strip matter is mechanically and automatically cut in a position closely adjacent to the needle location. Accordingly, as compared to the cutting with scissors by the operator, not only work efficiency is improved, but also work burden is reduced significantly, thereby avoiding shortcomings that the operator suffers from peritendinitis. It is also possible to minimize strip matter losses at a sewing stop portion and the next sewing start portion.

In addition, since it is arranged such that the whole of the cutting part is shifted between the cutting action position and the non-action position, no special reconstruction are required for the throat plate and throat plate mount, unlike a conventional cutting device in which a stationary blade is attached to the side of a throat plate and only a movable blade reciprocates between the cutting action position and the non-action position. Further, in the cutting device of the invention it is arranged such that impacting force upon cutting action is not directly applied to the sewing machine bed. Therefore, when it is used with a vertical barrel special bed sewing machine, a sufficient improvement in strength and durability is achieved without any reinforcement of its slender barrel cylinder bed part.

According to a second aspect of the invention, the cutting device of the first aspect is characterized in that the cutting part of the strip matter cutting unit is provided with a pick-up portion which picks up a strip matter from the surface of the sewing machine bed in response to shift from the non-action position to the cutting action position, the strip matter picked up by the pick-up portion being subjected to cutting. With this arrangement, a strip matter to be cut is picked up temporarily from the top surface of the sewing machine bed and then cut at a vertically spaced point above the top surface of the bed, thereby the cutting part and the top surface of the bed are free from damages.

According to a third aspect of the invention, the cutting device of the second aspect is characterized in that the cutting part further comprises a strip matter receiving portion which is integrally formed with a rotary cutting blade and a pickup portion in a continuous fashion. With this arrangement, the cutting part becomes compact as a whole, and impact upon cutting is remarkably small. Thereby, when the cutting device is used with a vertical barrel special bed sewing machine, it does not present strength and durability problems, without any special reinforcement of a slender barrel cylinder bed part.

According to a fourth aspect of the invention, the cutting device of the first, second or third aspect is characterized in that the cutting part shifting means comprises a rock arm which is fee to rock reciprocally about a supporting point at a predetermined position, and an arm driving means for driving the rock arm to rock. With this arrangement, the cutting device can be made more compact as a whole. In addition, the function of shifting from the non-action position to the cutting action position and the function of picking up a strip matter can be performed continuously, which permits a greatly rational operation and increase the efficiency of strip matter cutting.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
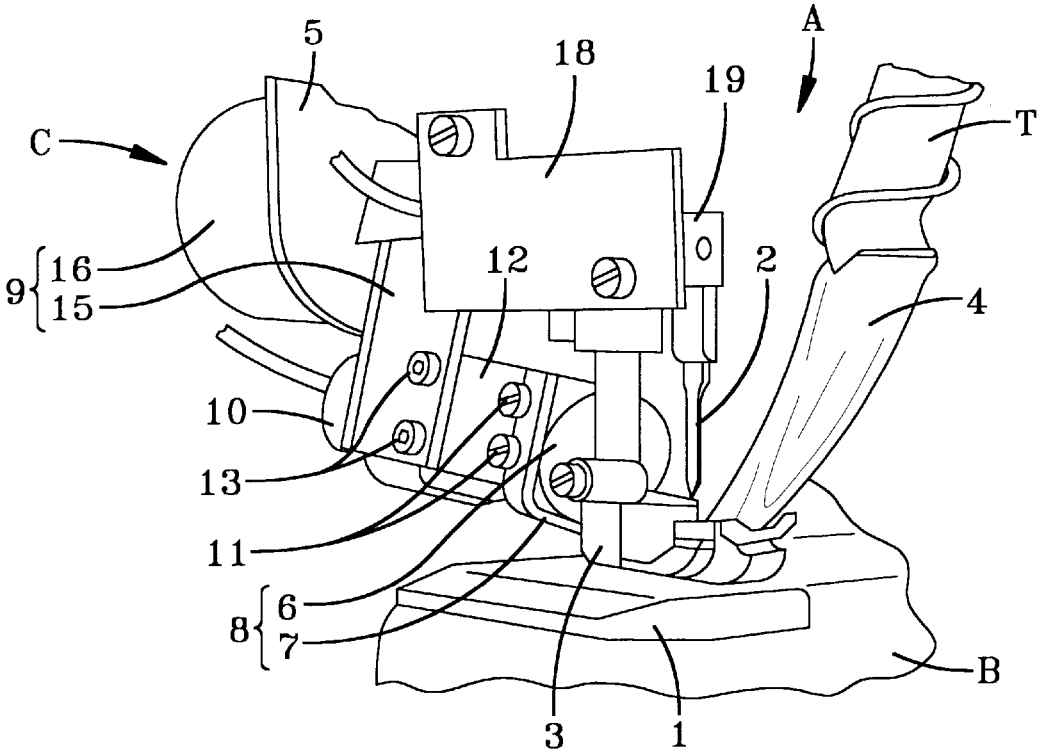
FIG. 1 is a left perspective view of a strip matter cutting device of the invention which is attached to a sewing machine arm of a vertical barrel special bed sewing machine.

One preferred embodiment of the invention will be described by referring to the drawings.

Figure 2:
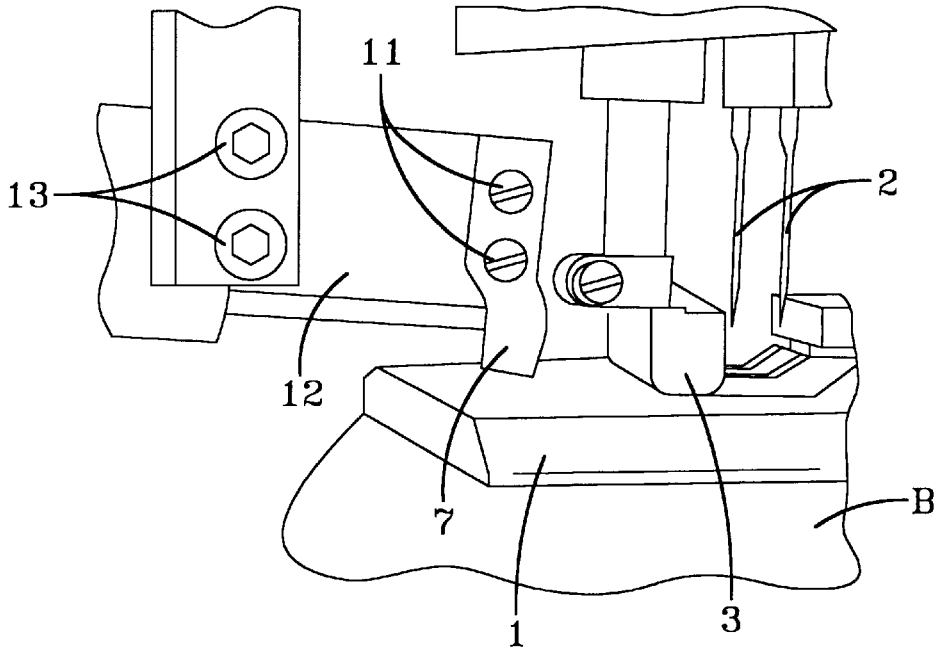
FIG. 2 is a left side view of FIG. 1.
Figure 8:
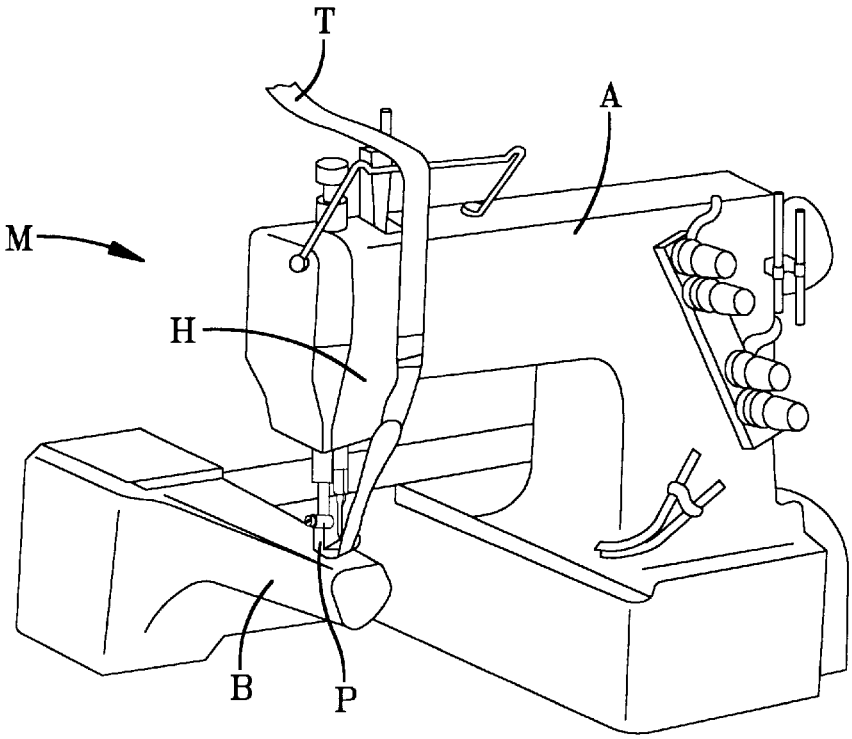
FIG. 8 is a perspective view of the appearance of a vertical barrel special bed sewing machine.

FIG. 1 is a left perspective view of a state where a strip matter cutting unit C of the invention is attached and fixed to a sewing machine arm A of a vertical barrel special bed sewing machine M as shown in FIG. 8. FIG. 2 is a left side view of FIG. 1. A feed dog (not shown) is provided in a special cylinder bed B of the bed sewing machine M, and a throat plate 1 having a needle location (not shown) is secured to the top surface of the bed sewing machine M. There are provided a needle 2 which moves vertically reciprocally such as to pass through the needle location of the throat plate 1, a pressure foot 3, and a tape guide 4 with which a tape T, as an example of strip matters to be sewed on an object, is fed and guided to a sewing point. The tape cutting unit C is mounted on the back face of the sewing machine arm A via a blanket 5.

The tape cutting unit C has a tape cutting part 8, a cutting part shifting means 9, and a motor 10. The tape cutting part 8 comprises a disk-like rotary cutting blade 6 for cutting a tape T sewed on an object in its width direction, and a tape receiving portion 7 having an approximately L-shape when viewed from front, which also forms part of a protection guard of the rotary cutting blade 6. The cutting part shifting means 9 shifts the whole of the tape cutting part 8 between a cutting action position (see FIGS. 1 and 2) which is closely adjacent to the rear of a needle location of the throat plate 1 on the top surface of the special cylinder bed B, and a non-action position at which the tape cutting part 8 is retracted upwardly from the top surface of the bed B such that an object transferred along the top surface of the bed B is free to pass through the needle location. The motor 10 is a driving means with which the rotary cutting blade 6 of the tape cutting part 8 is driven to rotate.

The tip of the cutting part shifting means 9 is secured, via a screw 13, to the base of a cutting blade mount 12 to which the tape receiving portion 7 is secured via a screw 11. The cutting part shifting means 9 comprises a rock arm 15 of which base is supported on the blanket 5 via a pivot 14 such that it is fee to rock reciprocally about the pivot 14, and a rotary cylinder 16 which is fixedly secured to the back face of the blanket 5 and drives the rock arm 15 to rock reciprocally via the pivot 14. The motor 10 for driving the rotary cutting blade 6 is secured to the rock arm 15.

Figure 3:
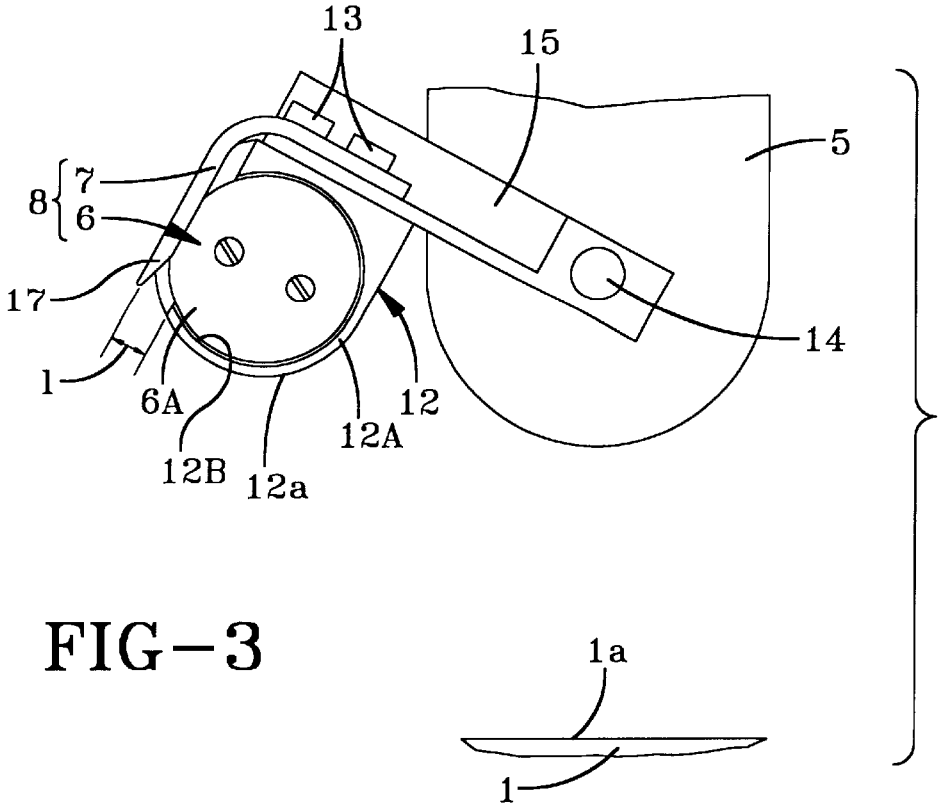
FIG. 3 is an enlarged front view of an important part, showing the strip matter cutting device being retracted to the non-action position.
Figure 4:
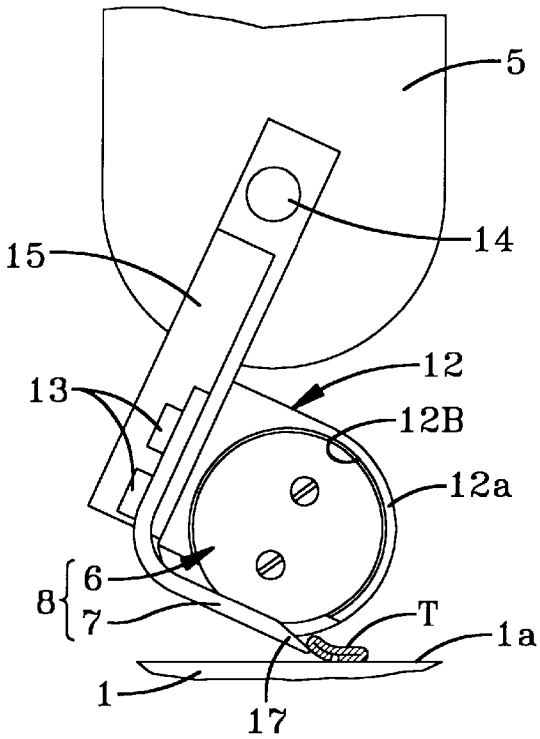
FIG. 4 is an enlarged front view of an important part, showing the strip matter cutting device being shifted from the non-action position to the cutting action position.
Figure 5:
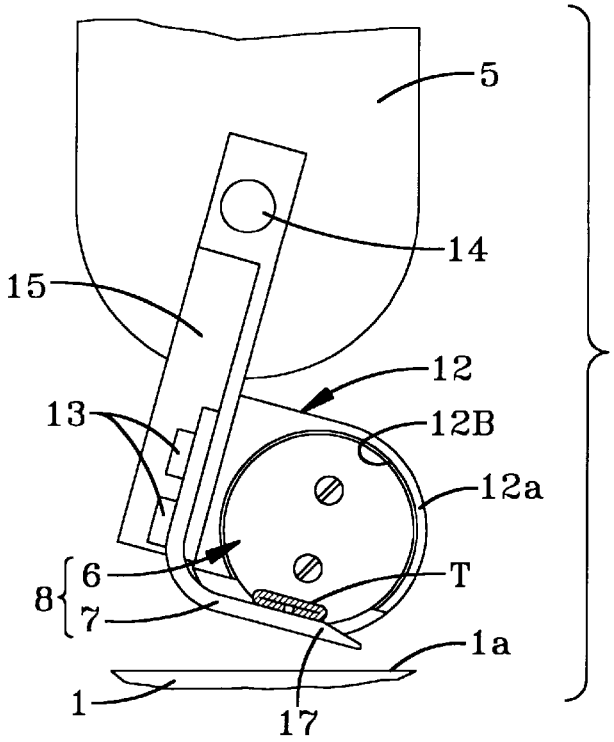
FIG. 5 is an enlarged front view of an important part, showing the strip matter cutting device being cutting a strip matter.
Figure 6:
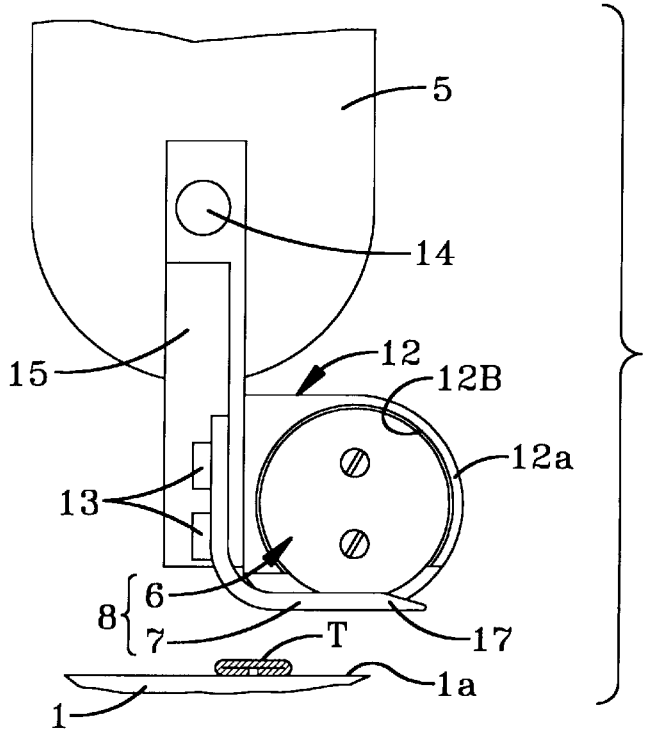
FIG. 6 is an enlarged front view of an important part, showing the strip matter being cut by the strip matter cutting device.

The tip of the L-shaped tape receiving portion 7 of the tape cutting part 8 is tapered as shown in FIG. 3, so as to form a tape pick-up portion 17 which picks up a tape T from the top surface la of the throat plate 1 as shown in FIG. 4, when the whole of the tape cutting part 8 is shifted from the non-action position to the cutting action position by rocking motion of the rock arm 15 in one direction. The tape T picked up by the tape pick-up portion 17 is cut in its width direction by the rotary cutting blade 6 and the receiving portion 7, as shown in FIG. 5.

The rotary cutting blade 6 is rotatably housed and held in an approximately semilunar recess 12B formed in the tip of the cutting blade mount 12. In order to prevent the finger or hand of the operator from being in contact with the rotary cutting blade 6, safety measures are taken by arranging such that a blade surface 6A does not project from a surface 12A of a circular cutting blade mount portion 12*a* surrounding the periphery of the blade surface 6A, and that distance 1 between the tip of the mount portion 12*a* and the tape pick-up portion 17 is narrow.

As shown in FIG. 1, an optical sensor 19 to detect the presence of an object to be sewed (materials) is attached to the sewing machine arm A immediately above the throat plate 1, via an adapter plate 18.

Figure 7:
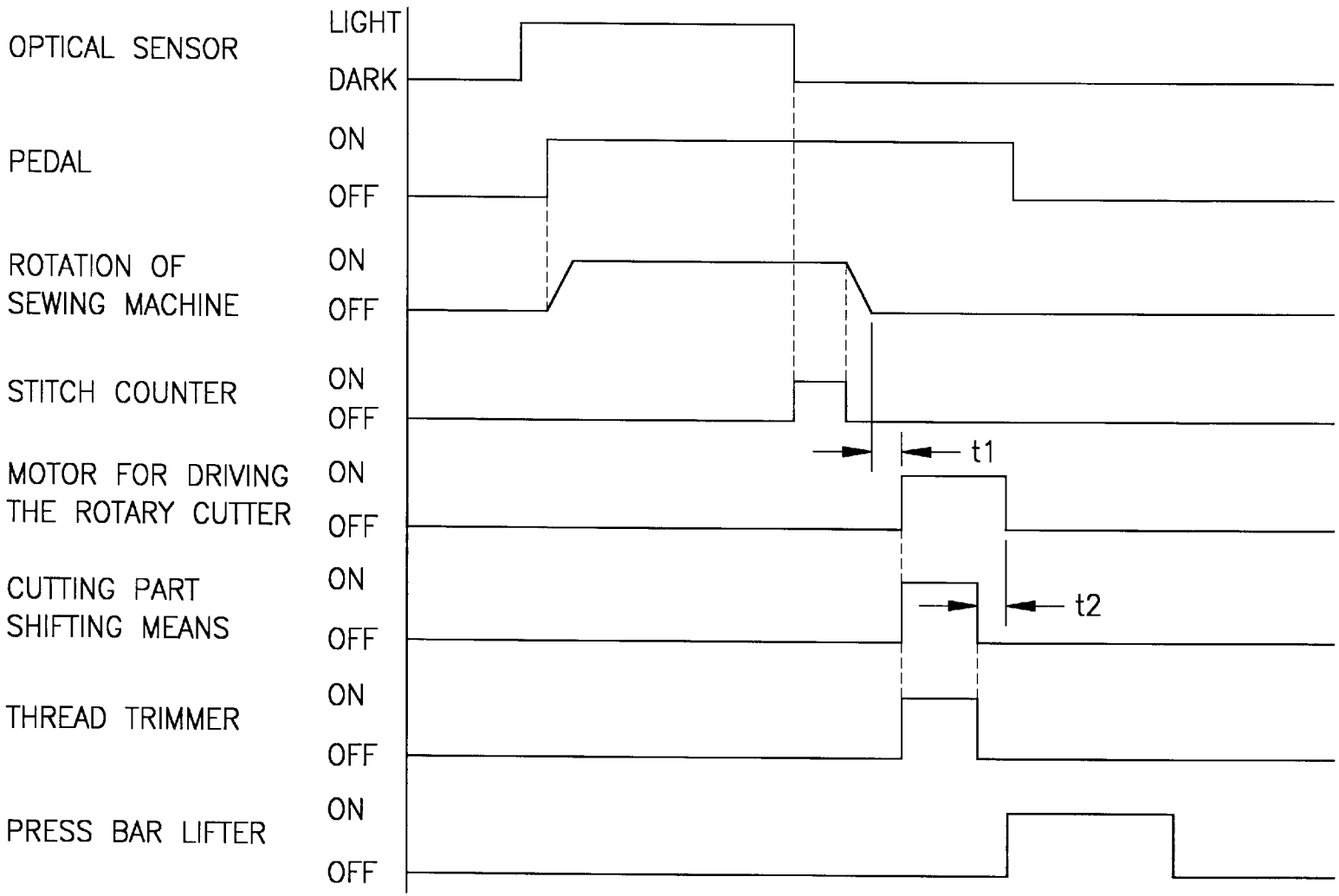
FIG. 7 is a timing chart illustrating a shoulder taping sewing operation.
Figure 9:
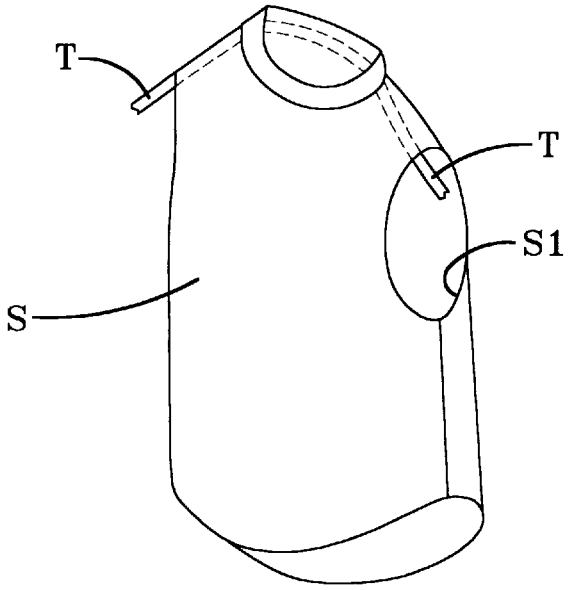
FIG. 9 is a diagram illustrating a shoulder taping sewing to a T-shirt.
Figure 10:
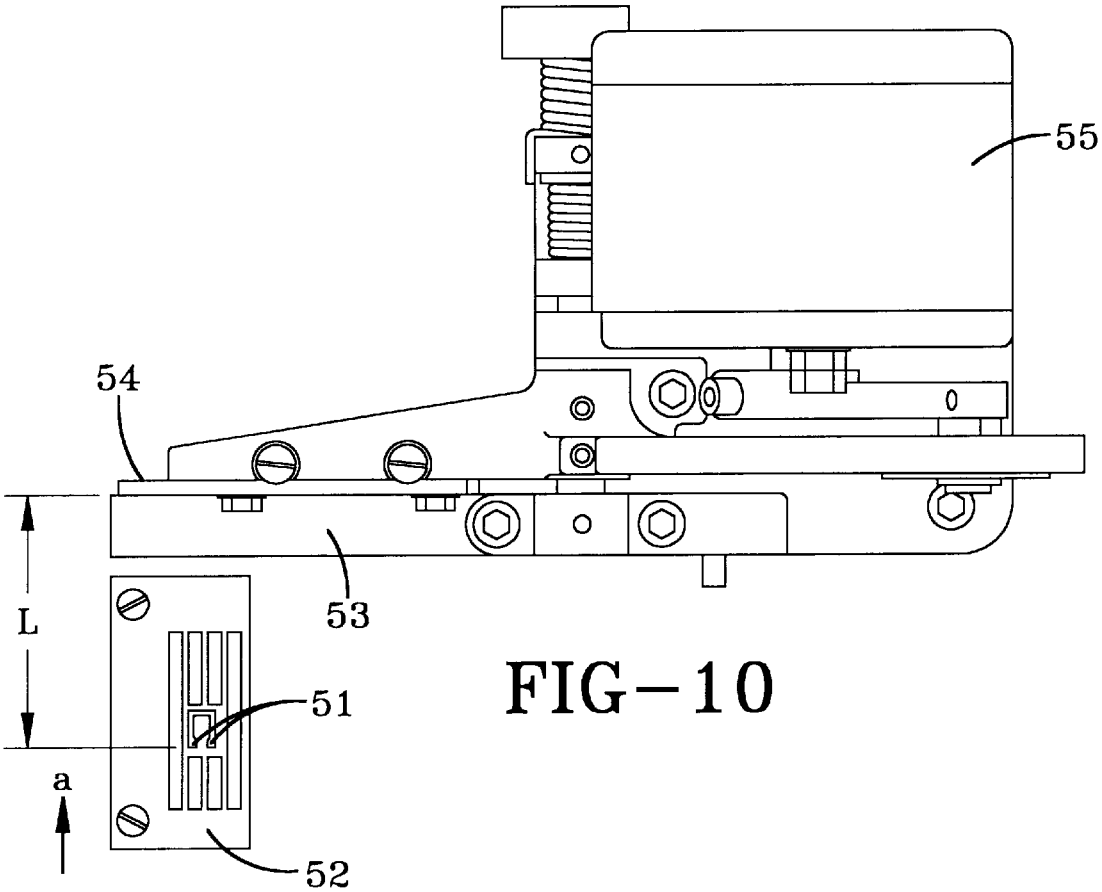
FIG. 10 is a plan view of an important part of a conventional strip matter cutting device.
Figure 11:
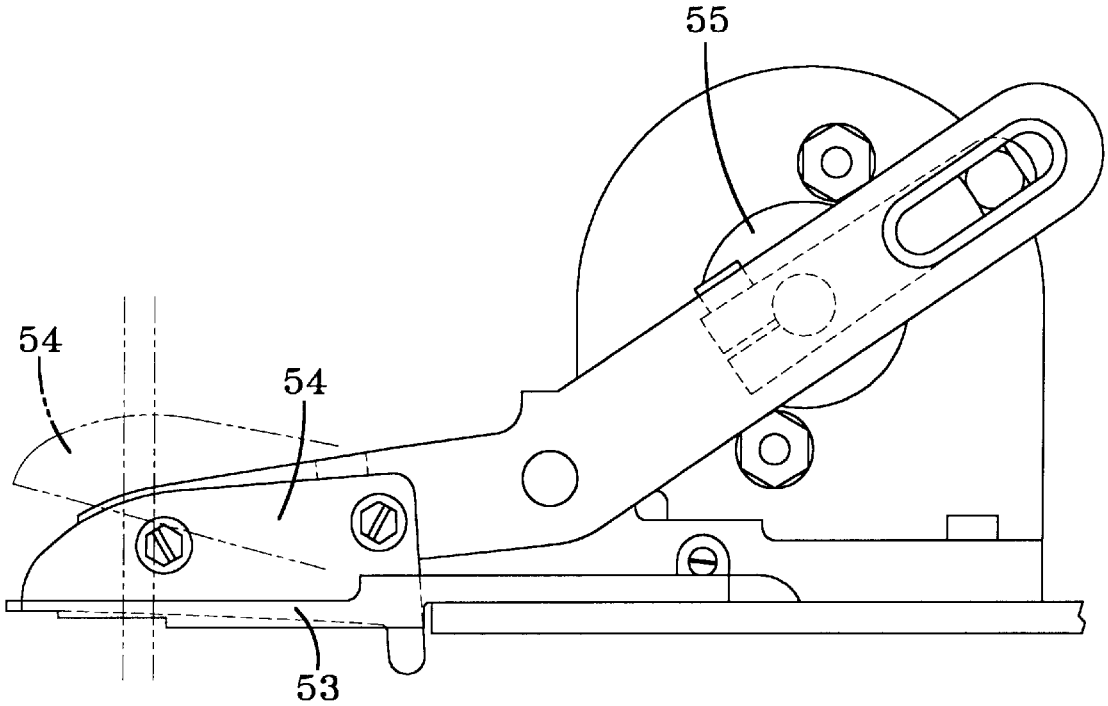
FIG. 11 is a front view of an important part of the strip matter cutting device of FIG. 10.

Referring to FIGS. 3 to 6, and the timing chart of FIG. 7, description will now be made of a shoulder taping sewing operation in which sewing is performed while sewing a tape T on the shoulders of a T-shirt S, as shown in FIG. 9, by using a vertical barrel special bed sewing machine M equipped with a tape cutting unit C as described.

When an arm hole SI of the T-shirt S is passed through a special cylinder bed B and fed and set on the surface of a throat plate 1, a sensor means 19 detects this to change its indicator from "light" to "dark."

In this state, when a foot control is pedaled, the vertical barrel special bed sewing machine M is started in rotation to feed the T-shirt S in a predetermined direction and, at the same time, to perform a predetermined sewing operation for sewing the tape T which is fed outside of the arm hole S1 via a tape guide 4. When a series of shoulder taping sewing is terminated, the indicator of the sensor 19 is changed from "dark" to "light." After the sewing machine M is rotated the number of stitches which is preset by a stitch counter (not shown), the rotation of the sewing machine M is stopped automatically with a needle 2 located in the vicinity of the top dead center.

After a predetermined waiting time t1 elapses from the stop of the sewing machine M, a thread trimmer (not shown), a motor 10 of the tape cutting unit C, and a rotary cylinder 16 of a cutting part shifting means 9 are actuated at the same time. By the simultaneous actuation of the motor 10 and the rotary cylinder 16, a rotary cutting blade 6 constituting a cutting part 8 is driven to rotate and a rock arm 15 is brought into rocking motion in one direction, so that the whole of the cutting part 8 is shifted from the non-action position at which the cutting part 8 is retracted upward to the left of the sewing machine arm A, to the cutting action position, as shown in FIG. 3.

In the course of shift of the entire cutting part 8, a tape pick-up portion 17 which is continuous with a receiving portion 7 picks up a tape T from the top surface la of a throat plate 1, as shown in FIG. 4. The tape T thus picked up is cut in its width direction by the rotary cutting blade 6 and the receiving portion 7, as shown in FIG. 5. The tape T thus cut drops on to the top surface 1*a* of the throat plate 1.

Since the whole of the cutting part 8 is retracted to the non-action position upward to the left of the sewing machine arm A at the time of the shoulder taping sewing, the cutting part 8 constitutes no obstruction to the feed of the T-shirt S as an object to be sewed. Thereby, T-shirt S is allowed to pass and move smoothly through the needle location of the throat plate 1, to ensure a predetermined taping sewing. In addition, upon termination of the taping sewing, the whole of the cutting part 8 is shifted to the cutting action position in the vicinity of the rear of the needle location of the throat plate 1 so as to cut the tape T mechanically and automatically at a position closely adjacent to the rear of the needle location. Therefore, as compared with the case where the operator cuts a tape with scissors, an improvement in work efficiency and a reduction in work burden are attainable. This avoids that the operator suffers from peritendinitis, and also minimizes tape losses at a sewing stop portion and the next sewing start portion.

After the above thread cutting and tape cutting are terminated, a thread trimmer returns to home position and comes to a stop, and the cutting part 8 of the tape cutting unit C is rocked and retracted to the non-action position upward to the left of the sewing machine arm A. Then, the actions of the motor 10 and the rotary cylinder 16 are stopped. In this case, the motor 10 retracted to the non-action position is held rotated for a predetermined time t2, thereby exhibiting a cleaning function of automatically removing tape chips and the like attached to the face of the rotary cutting blade 6.

At the same time that the action of the motor 10 is stopped, a presser bar lifter (not shown) is actuated to lift a pressure foot 3 automatically from the throat plate 1. While the pressure foot 3 is lifted (it is generally set to two to three seconds), the T-shirt S to which taping sewing is completed is taken out of a special cylinder bed B of the vertical barrel special bed sewing machine M to its front. After the pressure foot 3 drops down on the throat plate 1, the following T-shirt S is set and the shoulder taping sewing is started by changing the indicator of the sensor 19 to "dark." Hereat, pedaling of the foot control is released by the time the next sewing is started.

Figure 12:
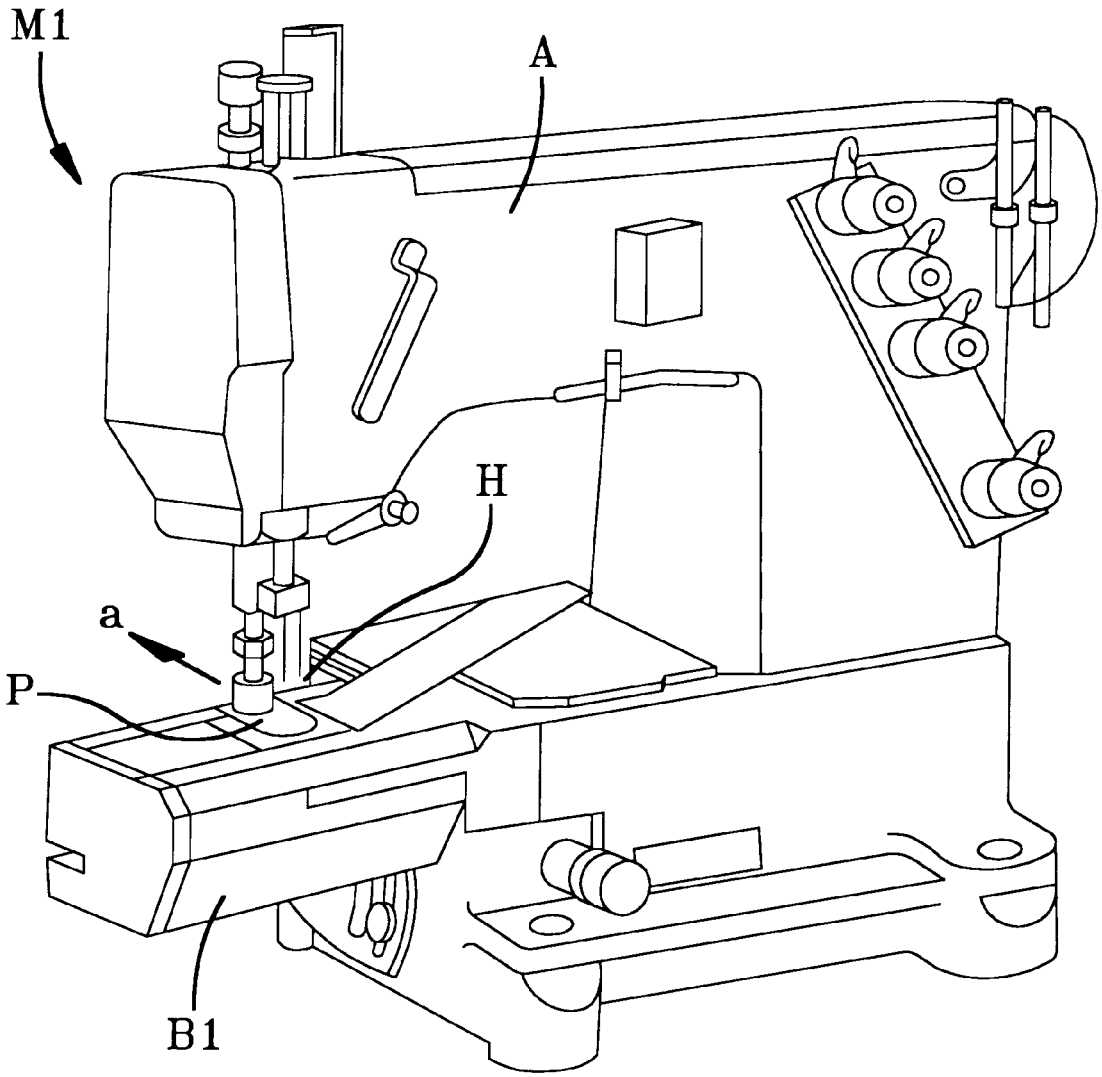
FIG. 12 is a perspective view of the appearance of a lateral barrel bed type covering chain stitch sewing machine.

Although the above embodiment discusses the case where the shoulder taping sewing to the T-shirt S is performed with the tape cutting unit C attached to the vertical barrel special bed sewing machine M, the cutting unit C is applicable to a sewing machine of high rotating speed. Particularly, in the shoulder taping sewing to the T-shirt S, the cutting unit C is preferably attached to a lateral barrel covering chain stitch sewing machine M1 as shown in FIG. 12, being the second most suitable one. This enables to eliminate an inefficient and exhausting task that the operator cuts a tape with scissors, and also improve work efficiency as a whole, as in the case with the above embodiment.

Although the foregoing embodiment discusses sewing of a tape as an example of strip matters, the same effects are obtainable in sewing other strip matters, e.g., rubber.

While the invention has been shown and described in detail, the foregoing description is in all aspects illustrative and not restrictive. It is therefore understood that numerous modifications and variations can be devised without departing from the scope of the invention.

What is claimed is:

1. A strip matter cutting device for a sewing machine comprising:

a strip matter cutting unit having a cutting part for cutting a strip matter sewed on an object in its width direction, said cutting part comprising a rotary cutting blade, and a strip matter receiving portion continuously and integrally formed with a strip matter pick-up portion;

a cutting part shifting means for shifting the whole of said cutting part between a cutting action position closely adjacent to the rear of a needle location on the top surface of a sewing machine bed, and a non-action position at which said cutting part is retracted upwardly from the top surface of said sewing machine bed such that said object transferred along the top surface of said sewing machine bed is free to pass through said needle location; and a driving means for driving said cutting part to effect cutting at said cutting action position.

2. A strip matter cutting device for a sewing machine as defined in claim 1 wherein said cutting part has said strip matter pick-up portion to pick up a strip matter from the top surface of said sewing machine bed in response to shift from said non-action position to said cutting action position, said strip matter picked up by said pick-up portion being cut by said cutting part.

3. A strip matter cutting device for a sewing machine as defined in claim 1 wherein said cutting part shifting means comprises a rock arm which is free to rock reciprocally about a supporting point at a predetermined position, and an arm driving means for driving said rock arm to rock.

4. A strip matter cutting device for a sewing machine as defined in claim 1 wherein said strip matter receiving portion constituting said cutting part is formed into an approximately L-shape when viewed from front, part of said receiving portion serving as part of a protection guard of said rotary cutting blade, and the tip of which being tapered as to form said pick-up portion.

5. A strip matter cutting device for a sewing machine as defined in claim 1 wherein said rotary cutting blade is housed and held in an approximately semilunar recess formed in the tip of a cutting blade mount, such that the surface of said rotary cutting blade does not project from the surface of a circular cutting blade mount portion.

6. A strip matter cutting device for a sewing machine as defined in claim 1 wherein the gap between the tip of said circular cutting blade mount portion and said strip matter pick-up portion is of such size as to prevent insertion of a finger.

7. A strip matter cutting device for a sewing machine comprising:

a strip matter cutting unit having a cutting part for cutting a strip matter sewed on an object in its width direction;

a cutting part shifting means for shifting the whole of said cutting part between a cutting action position closely adjacent to the rear of a needle location on the top surface of a sewing machine bed, and a non-action position at which said cutting part is retracted upwardly from the top surface of said sewing machine bed such that said object transferred along the top surface of said sewing machine bed is free to pass through said needle location;

a driving means for driving said cutting part to effect cutting at said cutting action position; and means for holding said cutting part in a driving state for cutting over a given time immediately after it is shifted from said cutting action position to said non-action position.

8. A strip matter cutting device for a sewing machine comprising:

a strip matter cutting unit having a cutting part for cutting a strip matter sewed on an object in its width direction;

an optical sensor to detect the presence of an object to be sewed attached to the sewing machine arm via an adapter plate;

a cutting part shifting means for shifting the whole of said cutting part between a cutting action position closely adjacent to the rear of a needle location on the top surface of a sewing machine bed, and a non-action position at which said cutting part is retracted upwardly from the top surface of said sewing machine bed such that said object transferred along the top surface of said sewing machine bed is free to pass through said needle location;

a driving means for driving said cutting part to effect cutting at said cutting action position; and means for holding said cutting part in a driving state for cutting over a given time immediately after it is shifted from said cutting action position to said non-action position.

* * * * *